United States Patent [19]

Elders

[11] Patent Number: 4,472,087

[45] Date of Patent: Sep. 18, 1984

[54] ROOF SUPPORT PIN

[76] Inventor: Gerald W. Elders, 38 Yakashba Estates, Prescott, Ariz. 86301

[21] Appl. No.: 367,582

[22] Filed: Apr. 12, 1982

Related U.S. Application Data

[62] Division of Ser. No. 134,939, Mar. 28, 1980.

[51] Int. Cl.[3] ..... E21D 20/00; E21D 21/00

[52] U.S. Cl. ..... 405/259; 411/513; 411/521

[58] Field of Search ..... 405/259–261, 405/244; 411/60, 61, 513, 521; 403/409, 344, DIG. 7, 374

[56] References Cited

U.S. PATENT DOCUMENTS

| | | | |
|---|---|---|---|
| 872,180 | 11/1907 | Hite | 411/513 |
| 1,142,471 | 6/1915 | White | 411/513 X |
| 1,304,885 | 5/1919 | Kennedy | 411/61 |
| 2,412,008 | 12/1946 | Reinhardt | 411/513 X |
| 3,227,030 | 1/1966 | Preziosi et al. | 411/521 |
| 3,557,402 | 1/1971 | Koehl | 411/521 X |
| 4,284,379 | 8/1981 | Chaiko | 405/259 X |

*Primary Examiner*—Dennis L. Taylor

*Attorney, Agent, or Firm*—Cohn, Powell & Hind

[57] ABSTRACT

A roof support pin for insertion into a roof bore having an opening comprising an elongate tube for insertion into the bore, the tube being compressed prior to insertion of the tube into the bore opening so that the tube expands to frictionally engage the bore a distance from the bore opening. In one embodiment, a roof support plate has a hole with a diameter smaller than the diameter of the bore. The plate hole compresses the diameter of the tube upon insertion of the tube into the bore through the plate hole. In one aspect, the tube includes adjacent opposed longitudinal edges forming a longitudinal slit. The tube edges engage and are turned resiliently inwardly of the tube at the longitudinal slit as the tube is circumferentially resiliently compressed, and resiliently coacting to provide an expansion force for frictional engagement of the tube with the bore.

4 Claims, 12 Drawing Figures

ROOF SUPPORT PIN

This application is a division of application Ser. No. 134,939, filed Mar. 28, 1980.

BACKGROUND OF THE INVENTION

This invention relates to a roof support pin in general and in particular to a roof support pin of the type employing a compressible tube for engagement with a roof bore. The prior art teaches the use of a compressible tube for roof support. In the prior art, a tube is forced into an undersized bore where it frictionally engages the bore to anchor itself. The prior art teaches the use of the bore to compress the tube.

In coal mines, it is generally necessary to leave a roof layer of top coal or shale through which a roof support pin must be mounted. This roof layer of top coal is quite fragile, and the force exerted on it by a tube being inserted into a undersized bore could result in the fracturing of the top coal thereby causing it to either fall or create a very dangerous condition. It is therefore important that the bore opening not be used to compress a tube.

SUMMARY OF THE INVENTION

This roof support pin provides a compressible tube which does not rely on the bore opening to compress the tube, and which does not frictionally engage a bore immmediately adjacent to the bore opening.

The roof support pin, for insertion into a roof bore having an opening, includes an elongate tube for insertion into the bore, and means resiliently compressing the tube prior to insertion of the tube into the bore so that the tube expands to frictionally engage the bore in spaced relation to the bore opening for anchoring the tube within the bore.

In one aspect, the compressing means includes a roof support plate having a hole with a diameter smaller than the diameter of the bore. The plate hole compresses the diameter of the tube upon insertion of the tube into the bore through the plate hole.

In another aspect, the compressing means is located adjacent to the bore hole. The compressing means engages and allows the tube to expand within the bore a distance from the bore opening whereby the tube does not engage the bore immediately adjacent to the bore opening.

In one embodiment, the tube includes a plurality of interior and exterior grooves. The grooves allow the tube to be circumferentially compressed by the plate hole prior to insertion into the bore.

In one aspect, the compressing means includes a plurality of rings longitudinally spaced axially on and retaining the tube compressed prior to insertion of the tube through the plate hole into the bore. The rings slidably engage the tube for retention at the plate, thereby allowing the tube to expand within the bore.

In another embodiment, the tube includes adjacent longitudinal edges forming a longitudinal slit. The two edges are turned inwardly at the longitudinal slit as a tube is circumferentially resiliently compressed with the edges engaging each other in an oppposed manner.

In one aspect, the compressing means includes a longitudinal clip constituting removable means which engages the edges of the tube within the tube for retaining the tube compressed. The longitudinal clip is removable from the tube edges for allowing the tube to expand after the tube is inserted into the bore.

In another aspect, the compressing means includes a spiral strip wrapping and retaining the tube compressed prior to insertion into the bore. The spiral strip is stripped from the tube as the tube is inserted through the plate hole.

In one aspect, the plate hole is partially defined by a pointed plate edge extending into the plate hole and engaging the spiral strip as the tube is inserted through the plate hole for cutting the spiral strip and releasing the spiral strip from the tube for expansion of the tube within the bore.

DESCRIPTION OF THE PREFERRED EMBODIMENT

Figure 1:
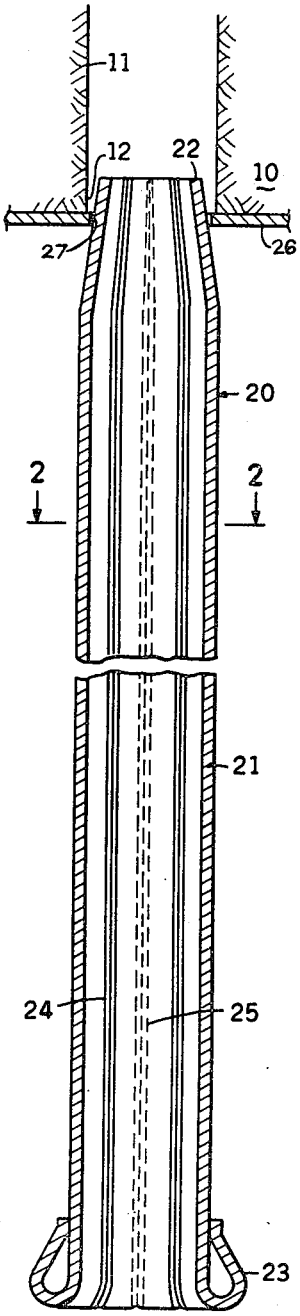
FIG. 1 is a cross sectional front elevational view of one embodiment of the roof pin.
Figure 2:
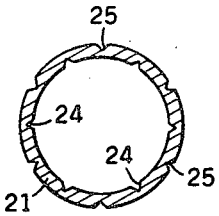
FIG. 2 is a cross sectional view taken on line 2—2 of FIG. 1.

Referring now by characters of reference to the drawings and first to FIGS. 1 and 2, it will be understood that a roof such as a mine roof 10 includes a bore 11 having an opening 12 for receiving a roof support pin, the preferred embodiment of which is indicated generally by 20 in FIG. 1.

The roof support pin 20 includes an elongate tube 21 having a tapered front end 22, a flanged head 23, a plurality of interior longitudinal grooves 24 and a plurality of exterior longitudinal grooves 25, and a roof support plate 26 having a hole 27. The hole 27 has a diameter which is smaller than the diameter of the bore 11.

The tube 21 is insertable into the bore 11 through the plate hole 27 with the plate hole 27 providing means resiliently compressing the tube 21 prior to insertion of the tube 21 into the bore 11. The interior and exterior grooves 24 and 25 allow the tube 21 to be circumferentially compressed by the plate hole 27. It is, of course, understood that the interior and exterior grooves 24 and 25 need not be longitudinal, but could comprise spiral, intermittent or otherwise be arranged to allow circumferential compression of the tube 21. When the tube 21 is to be inserted in a bore 11 in loose or soft material such as soil, it is preferred that the exterior grooves 25 not be continuous longitudinal grooves but rather be intermittant to provide an irregular surface of the tube 21 for greater holding power. The tube 21 expands to frictionally engage the bore 11 in spaced relation to the bore opening 12.

Figure 3:
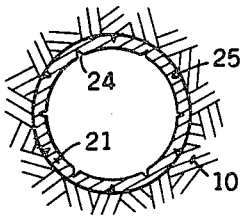
FIG. 3 is a cross sectional view taken on line 3—3 of FIG. 4.
Figure 5:
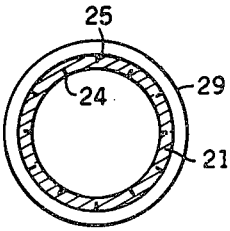
FIG. 5 is a cross sectional view taken on line 5—5 of FIG. 4.
Figure 4:
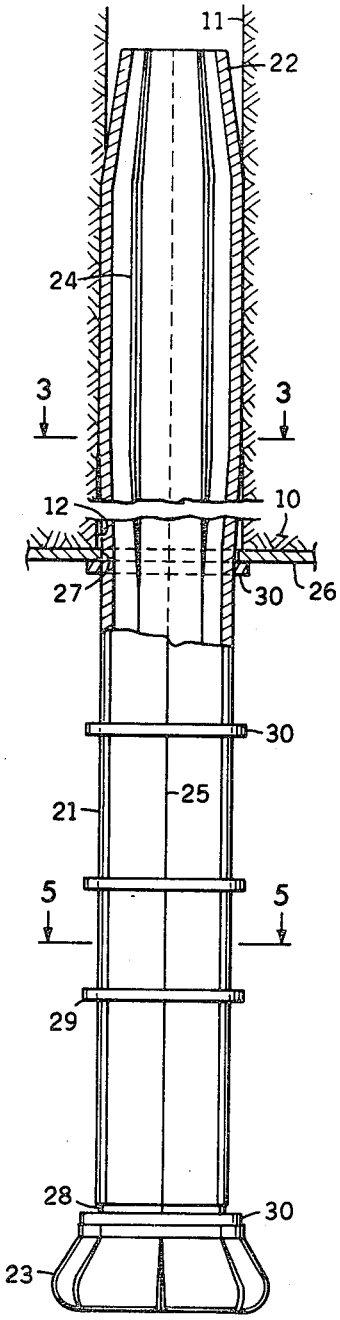
FIG. 4 is a front elevational view partially in cross section of another embodiment of the roof pin.

Referring now to the embodiment of FIGS. 3–5 in which similar parts are given the same reference numbers as for the embodiment of FIG. 1, the means for resiliently compressing the tube 21 includes a plurality of rings 30 longitudinally spaced axially on the tube 21. The rings 30 retain the tube 21 compressed prior to insertion of the tube 21 through the plate hole 27 into the bore 11. The rings 30 slidably engage the tube 21 for retention at the plate 26 for allowing the tube 21 to expand within the bore 11. In the embodiment of FIG. 4, the tube 21 includes a circumferential groove 28 adjacent to the head 30. The ring 29 constitutes a snap ring which is seated in the circumferential groove 28 when the tube 21 is fully inserted in the bore 11 through the plate 26. The snap ring 29 provides for support of the plate 26 by the tube 21, in addition to the support provided by the head 23.

Figure 6:
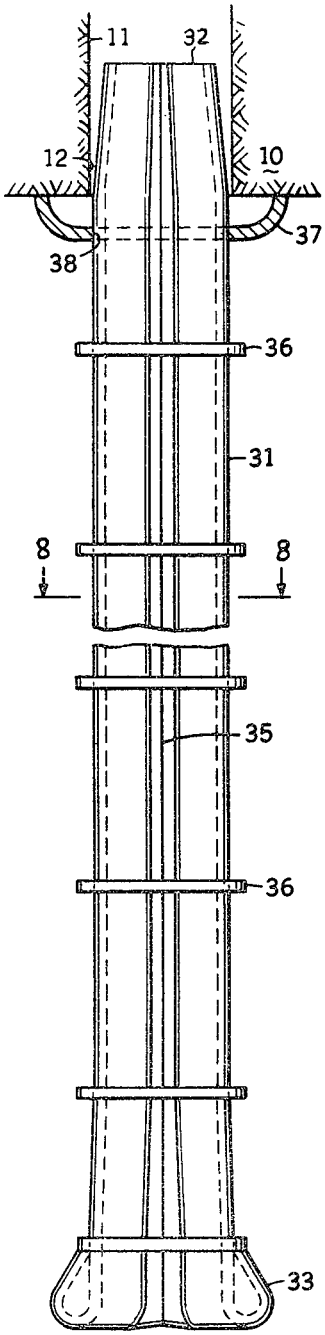
FIG. 6 is an elevational view partially in cross section of yet another embodiment of the roof pin.
Figure 7:
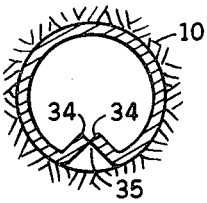
FIG. 7 is a cross sectional view of a roof pin of the embodiment of FIG. 6 shown within a bore.
Figure 8:
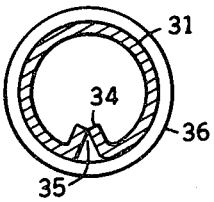
FIG. 8 is a cross sectional view taken on line 8—8 of FIG. 6.

Referring now to FIGS. 6–8 another preferred embodiment of a roof support pin includes a longitudinal tube 31 having a tapered end 32, a flanged head 33 and having adjacent longitudinal edges 34 forming a longitudinal slit 35. The edges 34, engage and turn inwardly as the tube 31 is circumferentially resiliently compressed. As shown in the drawings, the inturned walls provide a closed configuration inwardly of the tube and open outwardly of the tube.

In the embodiment of FIG. 6, a plurality of longitudinally spaced rings 36 retain the tube compressed prior to insertion of the tube 31 into the bore 11. It is understood that the tube 31 can be inserted in the bore 11 through a plate hole 27 in a plate 26 in a manner similar to the embodiment of FIG. 4, or the tube 31 can be compressed by the plate hole 27 as in FIG. 1. In FIG. 6, a concave washer 37 having a hole 38 replaces the plate 26 and plate hole 27 of FIG. 4 and the washer 37 retains the rings 36 when the tube 31 is inserted into the bore 11 through the washer hole 38.

Figure 9:
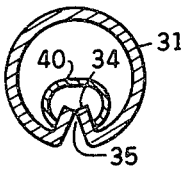
FIG. 9 is a cross sectional view of another embodiment of the roof pin.

In the embodiment of FIG. 9, a longitudinal clip 40 comprises removable means which constitutes means retaining the tube 31 compressed. The clip 40 engages the inturned edges 34 within the tube 31 to retain the tube 31 compressed. After the tube 31 is inserted into a bore 11, the clip 40 is removed thereby allowing the tube 31 to resiliently expand and frictionally engage the bore 11.

Figure 10:
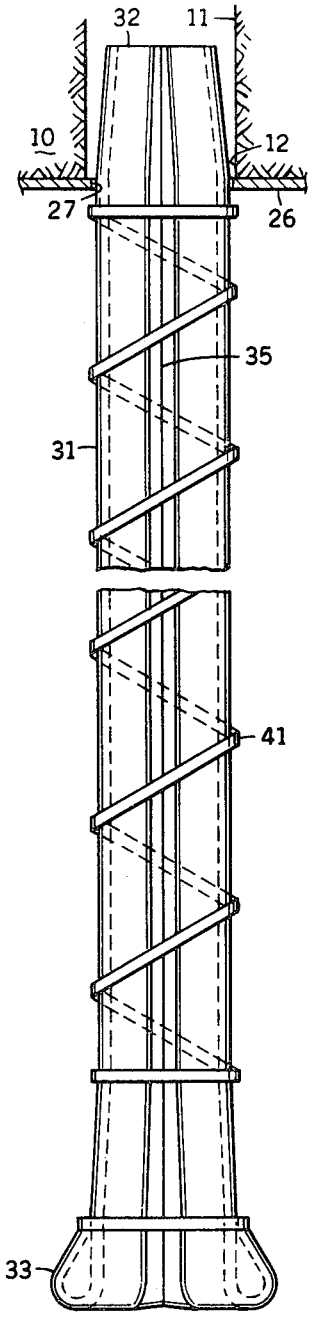
FIG. 10 is an elevational view partially in cross section of another embodiment of the roof pin.
Figure 11:
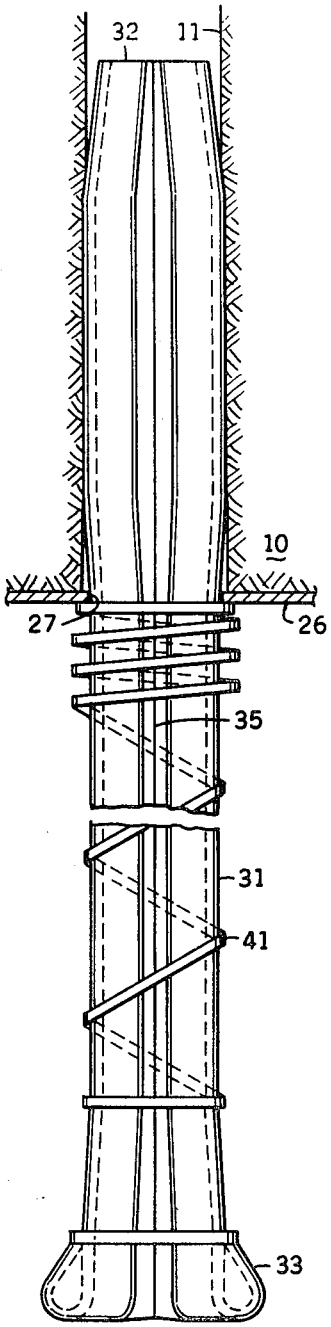
FIG. 11 is an elevational view partially in cross section of the roof pin of FIG. 10 shown inserted partially into the bore.

In the embodiment of FIG. 10, the tube 31 is retained resiliently compressed by a spiral strip 41 attached to the tube 31. The strip 41 is stripped from the tube 31 by the plate 26 as the tube is inserted into the bore 11 through the plate hole 27. The spiral strip 41 can constitute the removable means and remain on the tube 31 until the tube 31 is fully inserted in the bore 11.

Figure 12:
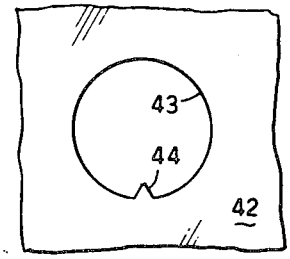
FIG. 12 is a partial plan view of an embodiment of the plate.

In a modified embodiment as shown in FIG. 12, a plate 42 includes a hole 43 partially defined by a pointed plate edge 44 extending into the plate hole 41. The tube 31 is inserted into the bore 11 through the plate hole 43 for cutting the spiral strip 41 and releasing the spiral strip 41 from the tube 31 for expansion of the tube 31 within the bore 11.

It is thought that the structural features and functional advantages of the roof support pin have become fully apparent from the foregoing description of parts, but for completeness of disclosure the operation of the device will be briefly discussed. It is understood that the roof support pins are utilized not only for roof support, but can be inserted in walls when wall support is required.

Referring first to FIG. 1, the roof support plate 26 is held against the roof 10 by the tube 21. The tube 23 engages the roof support plate 26 while the tube 21 frictionally engages the bore 11 to support the roof plate 26.

It is important that the bore opening 12 not be required to compress the tube 21. Therefore the plate hole 27 is formed with a diameter smaller than the diameter of the bore 11. The tube 21 is inserted into the bore 11 through the plate hole 27 with the plate hole 27 circumferentially compressing the tube 21 so that the tube 21 circumferentially expands within the bore a distance from the bore opening 12 and does not engage the bore 11 immediately adjacent to the bore opening 12. FIG. 2 shows a cross section of the tube 21 uncompressed showing the interior and exterior grooves 24 and 25 fully opened. When the tube 21 is passing through the plate hole 27, the cross section of the tube 21 would be similar to the tube cross section shown in FIG. 5. The tube 21 partially expands as indicated in FIG. 3 to frictionally engage the bore 11 to anchor the tube 21 within the bore 11.

As disclosed in FIG. 4, the tube 21 can be compressed prior to insertion of the tube 21 into the plate hole 27. In this embodiment, a plurality of rings 30 hold the tube 21 compressed as indicated in FIG. 5. As the tube 21 is inserted through the plate hole 27 into the bore 11, the rings 30 successively engage the plate 26 allowing the tube 21 to slide through the rings 30 and plate hole 27 and to expand within the bore 11. It is apparent that the plate hole 27 and rings 30, being adjacent to the bore opening 12, do not allow full expansion of the tube 21 immediately at the bore opening 12, thereby preventing the tube 21 from applying lateral force to the bore opening 12.

Another resiliently compressible tube 32 is disclosed in FIGS. 6–11. In this embodiment, longitudinal edges 34 forming a longitudinal slit 35 are turned inwardly as the tube 31 is circumferentially compressed. It is important that the edges 34 engage each other in an oppposed manner thereby providing an additional expansion force for greater frictional engagement with the bore 11. It is apparent that this tube 31 can be compressed by a plate 26 in a manner similar to that shown in regard to tube 21 of FIG. 1. Likewise, the tube 31 can be held compressed by a plurality of longitudinally spaced rings 36 as disclosed in FIG. 6, and the tube 31 can be inserted through a plate 26 in a manner similar to tube 21 of FIG. 4.

In FIG. 6, a concave washer 37 engages the roof 10 with the tube 31 being inserted through a hole 38 in the concave washer 37, the washer 37 engaging the rings 36 in a manner similar to the plate 26 of FIG. 4. However, the concave washer 37 provides a hole 38 which is spaced a distance from the bore opening 12.

A clip 40, as disclosed in FIG. 9, can be used to retain the tube 31 compressed. When the clip 40 is utilized, the tube 31 is inserted into the bore 11 through a plate 26 or through a washer 27. After the tube 31 has been inserted into the bore 11, the clip 40 is removed allowing the tube 31 to expand and frictionally engage the bore 11 as disclosed in FIG. 7. Another means of retaining the tube 31 compressed is a spiral strip 41 as disclosed in FIG. 10. The spiral strip 41 can be stripped away by the plate 26 as the tube is inserted in the bore 11 as disclosed in FIG. 11.

In another preferred embodiment, the plate 42 includes a plate hole 43 having a pointed plate edge 44 extending into the plate hole 43. The pointed edge 44 engages the spiral strip 41 for cutting the spiral strip 41 as the tube 31 is inserted into the bore 11 through the plate hole 43.

As is apparent, either the plate 26 or the rings 36 or 30 can provide means for compressing the tube adjacent to the bore opening 12 and prevent the tube 21 or 31 from engaging the bore 11 immediately adjacent to the bore opening 12. A single ring 30 could be utilized adjacent to the plate 26 to compress the tube 21 or 31 in which case, the plate hole 27 need not be of a smaller diameter than the bore 11.

I claim as my invention:

1. A roof support pin for insertion into a roof bore, comprising:

(a) an elongate tube for insertion into the bore, the tube including a wall having an outer portion and a single pair of adjacent opposed inturned longitudinal wall portions formed with said outer wall portion, said inturned wall portions being movable outwardly of the tube for increasing the size of the tube for frictional engagement of the tube within the bore the single pair of longitudinal wall portions resiliently cooperating to provide the expansion.

2. A roof support pin as defined in claim 1, in which:

(b) the single pair of longitudinal walls provide a closed configuration inwardly of the tube and opening outwardly of the tube.

3. A roof support pin for insertion into a roof bore, comprising:

(a) an elongate tube for insertion into the bore, the tube including longitudinal means inwardly of the tube which is resiliently compressible, and provides an expansion force for frictional engagement of the tube within the bore, and (b) the longitudinal means including adjacent, opposed longitudinal edges forming a longitudinal slit, the tube edges engaging and turned resiliently inwardly of the tube as the tube is circumferentially resiliently compressed, and resiliently coacting to provide the expansion force.

4. A roof support pin as defined in claim 3, in which:

(c) the inturned tube edges provide a closed configuration inwardly of the tube, the tube edges opening outwardly of the tube, and resiliently coacting to provide the expansion force.

* * * * *